US008822394B2

(12) United States Patent
Daegling

(10) Patent No.: US 8,822,394 B2
(45) Date of Patent: Sep. 2, 2014

(54) LUBRICATING GREASE COMPOSITIONS

(75) Inventor: Stefan Daegling, Hamburg (DE)

(73) Assignee: Shell Oil Company, Houston, TX (US)

( * ) Notice: Subject to any disclaimer, the term of this patent is extended or adjusted under 35 U.S.C. 154(b) by 190 days.

(21) Appl. No.: 13/390,781

(22) PCT Filed: Aug. 18, 2010

(86) PCT No.: PCT/EP2010/062061

§ 371 (c)(1),
(2), (4) Date: Mar. 22, 2012

(87) PCT Pub. No.: WO2011/020863

PCT Pub. Date: Feb. 24, 2011

(65) Prior Publication Data

US 2012/0190602 A1 Jul. 26, 2012

(30) Foreign Application Priority Data

Aug. 18, 2009 (EP) ..... 09168076

(51) Int. Cl.
*C10M 105/36* (2006.01)
*C10M 115/08* (2006.01)
*C10M 171/00* (2006.01)

(52) U.S. Cl.
CPC ..... *C10M 171/002* (2013.01); *C10M 2207/126* (2013.01); *C10M 2207/025* (2013.01); *C10M 115/08* (2013.01); *C10N 2230/68* (2013.01); *C10N 2250/10* (2013.01); *C10M 2207/026* (2013.01); *C10N 2240/04* (2013.01); *C10M 2215/1026* (2013.01); *C10M 2215/064* (2013.01); *C10N 2220/032* (2013.01)
USPC ..... 508/496; 508/552

(58) Field of Classification Search
USPC ..... 508/496, 552
See application file for complete search history.

(56) References Cited

U.S. PATENT DOCUMENTS

| | | | | |
|---|---|---|---|---|
| 6,037,314 | A | 3/2000 | Kondo et al. | 508/363 |
| 2005/0152628 | A1 | 7/2005 | Egami et al. | |
| 2009/0088354 | A1* | 4/2009 | Berry et al. | 508/388 |
| 2010/0029524 | A1* | 2/2010 | Fujinami et al. | 508/496 |
| 2010/0035779 | A1* | 2/2010 | Fujinami et al. | 508/496 |

FOREIGN PATENT DOCUMENTS

| | | | |
|---|---|---|---|
| EP | 0668342 | 8/1995 | C10G 65/04 |
| EP | 0776959 | 6/1997 | C10G 65/04 |
| EP | 1602710 | 12/2005 | C10M 159/06 |
| EP | 1889897 | 2/2008 | C10M 169/00 |
| EP | 1967753 | 9/2008 | |
| EP | 2080799 | 7/2009 | C10M 169/02 |
| WO | WO9721788 | 6/1997 | C10G 67/04 |
| WO | WO9920720 | 4/1999 | C10M 143/08 |
| WO | WO9941332 | 8/1999 | C10G 69/02 |
| WO | WO0008115 | 2/2000 | C10G 2/00 |
| WO | WO0014179 | 3/2000 | C10G 2/00 |
| WO | WO0014183 | 3/2000 | C10G 45/58 |
| WO | WO0014187 | 3/2000 | |
| WO | WO0014188 | 3/2000 | C10M 105/04 |
| WO | WO0015736 | 3/2000 | C10G 65/00 |
| WO | WO0118156 | 3/2001 | C10M 101/02 |
| WO | WO0157166 | 8/2001 | C10M 171/02 |

* cited by examiner

*Primary Examiner* — Vishal Vasisth

(57) ABSTRACT

Use of a lubricating grease composition in a mass flywheel application wherein the lubricating grease composition comprises: (i) a base oil having a density in the range of from 800 to 1000 $Kg/m^3$; and (ii) a urea compound having a density in the range of from 850 to 1050 $Kg/m^3$; wherein the difference in the densities of the base oil (i) and the urea compound (ii) is less than 50 $Kg/m^3$. The lubricating grease compositions according to the present invention are particularly useful for reducing oil bleeding and for improving shear stability properties in a dual mass flywheel application.

5 Claims, No Drawings

LUBRICATING GREASE COMPOSITIONS

PRIORITY CLAIM

The present application claims priority from PCT/EP2010/062061, filed 18 Aug. 2010, which claims priority from European patent application 09168076.9, filed 18 Aug. 2009.

FIELD OF THE INVENTION

The present invention relates to lubricating grease compositions, particularly to lubricating grease compositions for use in flywheel applications, in particular, for use in dual mass flywheel applications.

BACKGROUND OF THE INVENTION

The primary purpose of lubrication is separation of solid surfaces moving relative to one another, to minimize friction and wear. The materials most frequently used for this purpose are oils and greases. The choice of lubricant is mostly determined by the particular application.

Lubricating greases are the lubricants of choice in a dual mass flywheel application. A dual mass flywheel eliminates excessive transmission gear rattle, reduces gear change/shift effort, and increases fuel economy. Dual mass flywheels are typically fitted to light-duty diesel trucks with standard manual transmissions and to higher performance luxury vehicles to dampen vibration in the drive train. This allows vehicles to be operated for longer periods without long term damage.

Greases based on lithium soap complexes are known for use in flywheel applications. Such greases have been found to provide satisfactory lubricating properties. However, due to ever increasing demands for higher performance, it would be desirable to provide greases for use in mass flywheel applications which exhibit improved lubrication properties, and in particular, improved oil bleeding and shear stability properties.

SUMMARY OF THE INVENTION

According to the present invention there is provided the use of a lubricating grease composition in a mass flywheel application wherein the lubricating grease composition comprises:

(i) a base oil having a density in the range of from 800 to 1000 Kg/m$^3$;and (ii) a urea compound having a density in the range of from 800 to 1000 Kg/m$^3$;

wherein the difference in the densities of the base oil (i) and the urea compound (ii) is less than 50 Kg/m$^3$.

According to the present invention there is further provided the use in a lubricating grease composition of (i) a base oil having a density in the range of 800 to 1000 Kg/m$^3$; and (ii) a urea compound having a density in the range of from 800 to 1000 Kg/m$^3$;

wherein the difference in the densities of the base oil (i) and the urea compound (ii) is less than 50 Kg/m$^3$; for reducing oil bleeding.

According to another aspect of the present invention there is provided the use in a lubricating grease composition of (i) a base oil having a density in the range of 800 to 1000 Kg/m$^3$; and (ii) a urea compound having a density in the range of from 800 to 1000 Kg/m$^3$;

wherein the difference in the densities of the base oil (i) and the urea compound (ii) is less than 50 Kg/m$^3$; for improving shear stability.

DETAILED DESCRIPTION OF THE INVENTION

The lubricating grease composition for use in the present invention comprises, as an essential component, a base oil.

There are no particular limitations regarding the base oil used in the lubricating compositions according to the present invention, and various conventional base oils may be conveniently used. The base oil may be of mineral or synthetic origin or may comprise mixtures of one or more mineral oils and/or one or more synthetic oils.

Base oils of mineral origin may be mineral oils including liquid petroleum oils and solvent-treated or acid-treated mineral lubricating oil of the paraffinic, naphthenic or mixed paraffinic/naphthenic type which may be further refined by hydrofinishing processes or dewaxing.

Suitable base oils for use in the lubricating oil composition of the present invention are Group I, Group II or Group V base oils, polyalphaolefins, Fischer-Tropsch derived base oils and mixtures thereof.

By "Group I" base oil, "Group II" base oil and "Group V" base oil in the present invention are meant lubricating oil base oils according to the definitions of American Petroleum Institute (API) categories I, II and V. Such API categories are defined in API Publication 1509, 15th Edition, Appendix E, April 2002.

Suitable Group I base oils for use herein are solvent processed high viscosity index base oils such as those sold by the Royal Dutch/Shell Group of Companies under the tradename "HVI", for example, HVI 160B.

Suitable Group II base oils for use herein include severely hydro processed high viscosity index base oils such as that sold under the tradename Motiva Star 12 commercially available from Motiva Enterprises LLC, Houston, Tex., USA, and that sold under the tradename Chevron 600R commercially available from Chevron Corporation, USA.

Suitable Group V base oils for use herein include naphthenic base oils from solvent or hydro processing production routes such as that sold under the tradename MVIN 170 commercially available from the Royal Dutch/Shell Group of Companies.

Suitable Fischer-Tropsch derived base oils that may be conveniently used as the base oil in the lubricating oil composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Synthetic oils include hydrocarbon oils such as olefin oligomers (PAOs), dibasic acid esters, polyol esters, and dewaxed waxy raffinate. Synthetic hydrocarbon base oils sold by the Shell Group under the designation "XHVI" (trade mark) may be conveniently used.

Suitable PAOs include oligomers of linear alpha olefins (hydro finished) comprising linear alpha olefins having 8 to 16 carbon atoms.

Other suitable synthetic base oils include esterified derivatives of PAOs such as those having the tradenames Ketjenlube 230 and Ketjenlube 2700 commercially available from Italmatch Chemicals S.P.A., Italy, and alkylated naphthalenes such as those having the tradenames Synesstic 5 and Synesstic 12 commercially available from ExxonMobil Corporation.

Preferably the base oil is that of mineral origin, for example those sold by the Royal Dutch/Shell Group of Companies under the designation "HVI" such as for example, HVI 170, and that sold under the tradename Motiva Star 12 from Motiva Enterprises, Houston, Tex., USA.

Preferably, the lubricating composition comprises at least 30 wt. % base oil, preferably at least 50 wt. %, more preferably at least 70 wt. %, based on the total weight of the lubricating composition.

The base oil for use herein has a density in the range of from 800 to 1000 Kg/m$^3$, preferably in the range of from 850 to 950 Kg/m$^3$, more preferably in the range of from 850 to 920 Kg/m$^3$.

In addition to the base oil, the lubricating grease compositions for use in the present invention further comprise one or more urea compounds. Urea compounds used as thickeners in greases include the urea group (—NHCONH—) in their molecular structure. These compounds include mono-, di- or polyurea compounds, depending upon the number of urea linkages. Further, it is also possible to use various thickeners containing urea compounds such as urea-urethane compounds and urea-imido compounds. The lubricating composition preferably comprises from 2 to 20% by weight of urea thickener, more preferably from 5 to 20% by weight, based on the total weight of lubricating composition.

The urea compound for use herein has a density in the range of from 850 to 1050 Kg/m$^3$, preferably in the range of from 900 to 1000 Kg/m$^3$, more preferably in the range of from 900 to 970 Kg/m$^3$.

From the viewpoint of reducing oil bleeding properties, the difference in the densities of the base oil (i) and the urea compound (ii) is less than 50 Kg/m$^3$, preferably less than 30 Kg/m$^3$, more preferably less than 10 Kg/m$^3$.

There are no particular limitations regarding the urea compound used in the lubricating compositions according to the present invention as long as the density requirements described hereinabove are met.

The one or more urea thickeners in the grease composition of the present invention may be selected from urea compounds such as monourea, diurea, triurea, tetraurea or other polyureas. Preferred for use herein are diurea compounds.

The diurea compounds are reaction products of diisocyanates and monoamines which may be aliphatic amines, alicyclic amines and/or aromatic amines.

In a preferred embodiment herein the monoamines are aliphatic amines.

Aliphatic monoamines for use in preparing diurea compounds are preferably saturated or unsaturated aliphatic amines with from 8 to 24 carbon atoms and may be used in branched or straight-chain forms, but straight-chain forms are particularly preferred.

Examples of monoamines that may be conveniently used include octylamine, decylamine, dodecylamine, tetradecylamine, hexadecylamine, octadecylamine, oleylamine, aniline, p-toluidine, cyclohexylamine. Preferred examples of monoamines include octylamine, decylamine, dodecylamine, tetradecylamine, hexadecylamine, octadecylamine and oleylamine.

Further, examples of diisocyanates that may be conveniently used include aliphatic diisocyanates, alicyclic diisocyanates and aromatic diisocyanates: for example, 4,4'-diphenylmethane diisocyanate (MDI), tolylene diisocyanate (TDI), naphthalene diisocyanate, p-phenylene diisocyanate, trans-1,4-cyclohexane diisocyanate (CHDI), 1,3-bis-(isocyanatomethyl-benzene), 4,4'-dicyclohexylmethane diisocyanate (H12MDI), 1,3-bis-(isocyanatomethyl)-cyclohexane (H6XDI), hexamethylene diisocyanate (HDI), 3-isocyanatomethyl-3,3,5'-trimethylcyclohexylisocyanate (IPDI), phenylene diisocyanate, m-tetramethylxylene diisocyanate (m-TMXDI) and p-tetramethylxylene diisocyanate (p-TMXDI). In particular, 4-4'-diphenylmethane diisocyanate (MDI) is preferred.

The triurea compounds may be expressed by the general formula (1):

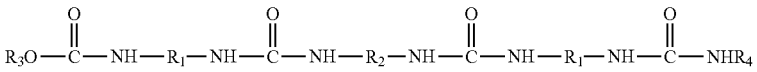

(1)

wherein $R_1$ and $R_2$ denote hydrocarbylene groups, and $R_3$ and $R_4$ denote hydrocarbyl groups.

These compounds are reaction products of 2 mol aliphatic, alicyclic or aromatic diisocyanate, 1 mol aliphatic, alicyclic or aromatic diamine, 1 mol aliphatic, alicyclic or aromatic amine and 1 mol aliphatic, alicyclic or aromatic alcohol. They are obtained by mixing the aforementioned compounds in base oil so as to give the respective aforementioned proportions, and effecting the reaction. For example, they may be obtained by reacting 2 mol tolylene diisocyanate, 1 mol ethylene diisocyanate, 1 mol octadecylamine and 1 mol octadecyl alcohol in a base oil.

Examples of aliphatic, alicyclic or aromatic diisocyanates that may be conveniently used to make triurea compounds include those diisocyanates listed above in relation to the preparation of diurea compounds. In particular, 4-4'-diphenylmethane diisocyanate (MDI), tolylene diisocyanate (TDI), trans-1,4-cyclohexane diisocyanate (CHDI) and 4,4'-dicyclohexylmethane diisocyanate (H12MDI) are preferred.

Examples of monoamines that may be conveniently used to prepare triurea compounds include those monoamines listed above in relation to the preparation of diurea compounds.

Aliphatic, alicyclic or aromatic diamines, aliphatic diamines that may be conveniently used in the preparation of triurea compounds are ethylenediamine, trimethylenediamine, tetramethylenediamine, hexamethylenediamine, octamethylenediamine and decamethylenediamine, alicyclic diamines such as diaminocyclohexane, and aromatic diamines such as phenylenediamine, benzidine, diaminostilbene and tolidine, which are all diamines with from 2 to 12 carbon atoms therein.

In a preferred embodiment herein, the diamines are aliphatic diamines. Examples of preferred aliphatic diamines are ethylenediamine, trimethylenediamine, tetramethylenediamine, hexamethylenediamine, octamethylenediamine and decamethylenediamine.

Examples of monoalcohols that may be conveniently used in the preparation of triurea compounds are aliphatic, alicyclic or aromatic alcohols branched or straight-chain. Aliphatic alcohols, which are $C_8$ to $C_{24}$ saturated or unsaturated aliphatic alcohols may be conveniently used. Straight-chain forms are particularly preferred.

In a preferred embodiment herein, the monoalcohols are aliphatic monoalcohols.

In particular octyl alcohol, decyl alcohol, dodecyl alcohol, tetradecyl alcohol, hexadecyl alcohol, octadecyl alcohol and oleyl alcohol are preferred.

An example of an alicyclic alcohol that may be conveniently used is cyclohexyl alcohol. Examples of aromatic alcohols that may be conveniently used include benzyl alcohol, salicyl alcohol, phenethyl alcohol, cinnamyl alcohol and hydrocinnamyl alcohol.

The tetraurea compounds may be expressed by the general formula (2):

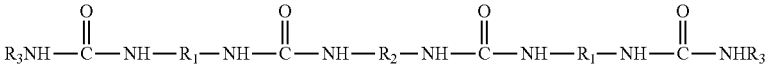

(2)

wherein $R_1$ and $R_2$ denote hydrocarbylene groups and $R_3$ denotes a hydrocarbyl group.

These compounds are reaction products of 2 mol aliphatic, alicyclic or aromatic diisocyanate, 1 mol aliphatic, alicyclic or aromatic diamine and 2 mol aliphatic, alicyclic or aromatic amine. They are obtained by mixing the aforementioned compounds in a normal base oil so as to give the respective aforementioned proportions, and effecting the reaction. For example, they may be obtained by reacting 2 mol tolylene diisocyanate, 1 mol ethylenediamine and 2 mol octadecylamine in base oil.

Examples of diisocyanates that may be conveniently used include those diisocyanates listed above in relation to the preparation of diurea compounds. In particular, 4-4'-diphenylmethane diisocyanate (MDI), tolylene diisocyanate (TDI), trans-1,4-cyclohexane diisocyanate (CHDI) and 4,4'-dicyclohexylmethane diisocyanate (H12MDI) are preferred.

Suitable aliphatic, alicyclic or aromatic diamines which may be used to prepare tetraureas include those diamines listed above in relation to the preparation of triurea compounds.

Suitable monoamines which may be used to prepare tetraureas include those monoamines listed above in relation to the preparation of diurea compounds.

As an example of an alicyclic monoamine, cyclohexylamine may be cited.

As examples of aromatic monoamines, aniline and p-toluidine may be cited.

Aliphatic monoamines are preferred herein for the preparation of tetraureas.

From the viewpoint of reducing oil bleeding and improving shear stability, it it preferred that the urea compound used herein is a diurea compound prepared by reacting a diisocyanate with a mixture of monoamines, wherein the mixture of monoamines comprises a $C_6$-$C_{10}$ aliphatic amine and a $C_{14}$-$C_{20}$ aliphatic amine. It is even more preferable that the mixture of monoamines comprises a $C_8$-$C_{10}$ aliphatic amine and a $C_{16}$-$C_{18}$ aliphatic amine. It is especially preferred that the mixture of monoamines comprises a $C_8$ aliphatic amine and a $C_{18}$ aliphatic amine. Preferably the diisocyanate is 4,4-diphenyl methane diisocyanate (MDI).

Various conventional grease additives may be incorporated into the lubricating greases of the present invention, in amounts normally used in this field of application, to impart certain desirable characteristics to the grease, such as oxidation stability, tackiness, extreme pressure properties and corrosion inhibition. Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulphurised sperm oils of natural or synthetic origin, sulphurised lard, sulphurised esters, sulphurised fatty acid esters, and similar sulphurised materials, organo-phosphates for example according to the formula $(OR)_3P{=}O$ where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine; one or more antirust additives; one or more friction-modifying additives; one or more viscosity-index improving agents; one or more pour point depressing additives; and one or more tackiness agents. Solid materials such as graphite, finely divided molybdenum disulphide, talc, metal powders, and various polymers such as polyethylene wax may also be added to impart special properties.

To reduce friction levels, those skilled in the art have largely looked to using organic molybdenum-based formulations, and there are numerous proposals in patent literature of such lubricating compositions.

The present invention will now be described by reference to the following Examples.

EXAMPLES

Examples 1 to 4 and Comparative Examples A, B, C, D and E

Grease compositions according to the invention and comparative grease compositions were prepared using the preparation method described below. The Grease compositions are shown in Table 1.

Preparation of the Grease Samples

A portion of the base oil is charged to the autoclave. The isocyanate is then added into the autoclave. The autoclave is closed. In a separate blending vessel base oil and amine are diluted and mixed. The isocyanate is heated to above the melting point. The mixture of base oil and amine is also heated above the melting point. The mixture of amine and base oil is pumped into the autoclave with stirring. The autoclave is heated to between 80° C. and 140° C. depending on the isocyanate and the amine. After the isocyanate and amine have reacted the balance of the isocyanate and amine is measured via Infra Red spectroscopy and amine number. If the reaction is complete, the performance additives can be added. If the reaction is not complete, the reaction can be completed by adding the appropriate reactant, either isocyanate or amine. After including the performance additives, the grease can be finished by for example, homogenization and deaeration.

Oil Separation Test Method

The oil separation properties of the grease samples were measured using the test method described below.

The oil separation of a mass flywheel grease can be measured using a dynamic torsion test rig. It is necessary to use completely new components for all inner parts of the mass fly wheel which have to be in line with material specification. The mass flywheel is filled with the grease (of the Examples or Comparative Examples) according to the filling guideline of the testing part. Then the mass flywheel is subjected to the following conditions: a temperature of 150° C., 6000rpm for 3 hours without oscillation. The mass flywheel is then left alone for 1 hour. The oil separation value of the grease is obtained by measuring the mass of the separated oil recovered after 1 hour.

Measurement of Shear Stability in the Mass Fly Wheel

The shear stability of a mass flywheel grease can be determined using a dynamic torsion test rig. It is necessary to use completely new components for all inner parts of the mass fly wheel which have to be in line with material specification. The mass flywheel is filled with the grease (of the Examples or Comparative Examples) according to the filling guideline of the testing part. Then the grease is subjected to the following conditions: a temperature of 150° C., 6000 rpm for 0.5 mill. cycles at 10 Hz with an oscillation of +/−20° angle. The shear stability value of the grease is the penetration value (as measured by ASTM D217) of the cooled grease sample.

Results of the oil separation and shear stability tests are shown in Table 1.

TABLE 1

| | Example: | | | | | | | | |
|---|---|---|---|---|---|---|---|---|---|
| | A* (wt %) | 1 (wt %) | B* (wt %) | 2 (wt %) | C* (wt %) | 3 (wt %) | D* (wt %) | E* (wt %) | 4 (wt %) |
| HVI 170[1] | 47.39 | 78.38 | 80.92 | 84.05 | 0 | 0 | 0 | 0 | 0 |
| HVI 650[2] | 40.37 | 7.8 | 0 | 0 | 0 | 0 | 0 | 0 | 0 |
| Motiva Star 12[3] | 0 | 0 | 0 | 0 | 65.9 | 68.5 | 71.21 | 70.35 | 71.21 |
| Radialube 7393[4] | 0 | 0 | 0 | 0 | 15.0 | 15.58 | 0 | 0 | 0 |
| Ketjenlube 2700[5] | 0 | 0 | 0 | 0 | 0 | 0 | 11.59 | 11.45 | 11.59 |
| Desmodur 44M[6] | 4.82 | 5.19 | 8.05 | 6.27 | 8.05 | 6.24 | 7.36 | 5.17 | 6.76 |
| Genamin 8R 100D[7] | 3.83 | 4.41 | 6.34 | 5.16 | 6.34 | 5.16 | 7.64 | 0 | 5.71 |
| Genamin 12 R 100D[8] | 1.39 | 0 | 2.31 | 0 | 2.51 | 0 | 0 | 0 | 0 |
| Armeen 18D[9] | 0 | 2.02 | 0 | 2.32 | 0 | 2.32 | 0 | 10.83 | 2.53 |
| Naugalube AMS[10] | 0.9 | 0.9 | 0.9 | 0.9 | 0.9 | 0.9 | 0.9 | 0.9 | 0.9 |
| Ralox LC[11] | 0.5 | 0.5 | 0 | 0 | 0 | 0 | 0 | 0 | 0 |
| Ionox 220[12] | 0 | 0 | 0.5 | 0.5 | 0 | 0 | 0 | 0 | 0 |
| Additin RC 7010[13] | 0 | 0 | 0 | 0 | 0 | 0.5 | 0.5 | 0.5 | 0.5 |
| Irganox L 109[14] | 0 | 0 | 0 | 0 | 0.5 | 0 | 0 | 0 | 0 |
| Irganox L57[15] | 0.3 | 0.3 | 0.3 | 0.3 | 0.3 | 0.3 | 0.3 | 0.3 | 0.3 |
| Valirex Zn[16] | 0.5 | 0.5 | 0.5 | 0.5 | 0.5 | 0.5 | 0.5 | 0.5 | 0.5 |
| Results: | | | | | | | | | |
| Unworked penetration (0.1 mm) | 269 | 250 | 217 | 223 | 228 | 216 | 237 | 221 | 196 |
| Worked penetration (0.1 mm) | 273 | 274 | 230 | 250 | 244 | 244 | 261 | 267 | 216 |
| Shear Stability (unworked penetration after test) (0.1 mm) | NM | NM | 305 | 329 | NM | 341 | 346 | >450 | 312 |
| Oil Separation Value/g | 15 | 2 | 35 | 4 | 50 | 2 | 83 | 58 | 7 |

*Comparative Example

NM = not measured

[1]mineral oil having a viscosity at 40° C. of 110 $mm^2 s^{-1}$ and a viscosity index of 95 commercially available from Shell Oil Company

[2]mineral oil having a viscosity at 40° C. of 500 $mm^2/s$ and a viscosity index of 95 commercially available from Shell Oil Company

[3]mineral oil having a viscosity at 40° C. of 110 $mm^2 s^{-1}$ and a viscosity index of 95 commercially available from Motiva Enterprises LLC, P.O. Box 4540, Houston, Texas, USA.

[4]Synthetic ester commercially available from Oleon, Belgium

[5]PAO ester derivate commercially available from Italmach Chemical S.p.a., Italy.

[6]MDI commercially available from Bayer Material science, Germany

[7]C8 monoamine commercially available from Clariant, Germany

[8]C12 monoamine commercially available from Clariant, Germany

[9]C18 monoamine commercially available from Akzo Nobel, Netherlands

[10]aminic antioxidant commercially available from Chemtura Corporation, USA

[11]phenolic antioxidant commercially available from Raschig GmbH, Germany

[12]phenolic antioxidant commercially available from Raschig GmbH, Germany

[13]phenolic antioxidant commercially available from Rhein Chemie, Germany

[14]phenolic antioxidant commercially available from CIBA Geigy Specialties, Switzerland

[15]aminic antioxidant commercially available from CIBA Geigy Specialties, Switzerland

[16]corrosion inhibitor commercially available from Van Loocke, Belgium

Discussion

It can be seen from the results in Table 1 that the diurea greases prepared using a mixture of a $C_8$ monoamine and a $C_{18}$ monoamine (Examples 1, 2, 3 and 4) demonstrate significantly reduced oil separation compared to diurea greases prepared using a mixture of $C_8$ monoamine and $C_{12}$ monoamine (Comparative Examples A, B, C) or compared to diurea greases prepared using only a $C_8$ monoamine (Comparative Example D) or only a $C_{18}$ monoamine (Comparative Example E). In the oil separation test method described above a figure of less than 10 g for the oil separation value is considered to be acceptable.

It can also be seen from the shear stability results in Table 1 that the diurea greases prepared using a mixture of a $C_8$ monoamine and a $C_{18}$ monoamine demonstrate good shear stability as well as reduced oil separation. In particular, Example 2 (a diurea grease prepared from a mixture of $C_8$ monoamine and $C_{18}$ monoamine) has a shear stability value of 329 (×0.1 mm) (compared to a conventional urea grease which typically has a shear stability value of greater than 500 (×0.1mm)). Comparative Example B (a diurea grease prepared from a mixture of $C_8$ monoamine and $C_{12}$ monoamine) has good shear stability, but does not have good oil separation properties, as evidenced by an oil separation value far in excess of 10 g.

Further, Example 4 (a diurea grease prepared from a mixture of $C_8$ monoamine and a $C_{18}$ monoamine) has good shear stability (having a shear stability value of 312 (×0.1mm)). By contrast, Comparative Example C (a diurea grease prepared from a $C_8$ monoamine only) has borderline shear stability and Comparative Example D (prepared from a $C_{18}$ monoamine only) has poor shear stability. As well as not having good shear stability, Comparative Examples C and D do not have good oil separation properties either, as evidenced by oil separation values far in excess of 10 g.

What is claimed is:

1. A method comprising:

applying a lubricating grease composition to a mass flywheel, wherein the lubricating grease composition comprises:

(i) a base oil having a density in the range of from 800 to 1000 $Kg/m^3$; and (ii) a diurea compound having a density in the range of from 850 to 1050$Kg/m^3$;

wherein the difference in the densities of the base oil (i) and the diurea compound (ii) is less than 50 $Kg/m^3$, and wherein the diurea compound is obtained by reacting a diisocyanate and a mixture of monoamines, the mixture of monoamines comprising a $C_6$-$C_{10}$ aliphatic amine and a $C_{14}$-$C_{20}$ alphatic amine.

2. A method according to claim 1, wherein the mixture of monoamines comprises a $C_8$-$C_{10}$ aliphatic amine and a $C_{16}$-$C_{18}$ aliphatic amine.

3. A method according to claim 2, wherein the mixture of monoamines comprises a $C_8$ aliphatic amine and a $C_{18}$ aliphatic amine.

4. A method according to claim 3, wherein the diisocyanate is 4,4'-diphenyl methane diisocyanate.

5. A method according to claim 4, wherein the base oil is a mineral oil.

* * * * *